United States Patent [19]

Koch et al.

[11] 4,334,629

[45] Jun. 15, 1982

[54] COUNTERBALANCE MECHANISM FOR INCUBATOR HOOD

[75] Inventors: Robert J. Koch, McFarland; Douglas D. Carden, Barneveld; Michael H. Mackin, McFarland, all of Wis.

[73] Assignee: Airco, Inc., Montvale, N.J.

[21] Appl. No.: 225,089

[22] Filed: Jan. 14, 1981

[51] Int. Cl.[3] ..... B65D 43/14

[52] U.S. Cl. ..... 220/252; 220/335

[58] Field of Search ..... 220/252, 334, 335

[56] References Cited

U.S. PATENT DOCUMENTS 2,550,998 5/1951 Hilliker ..... 220/252

*Primary Examiner*—George T. Hall

*Attorney, Agent, or Firm*—Roger M. Rathbun; Larry R. Cassett

[57] ABSTRACT

A counterbalance mechanism is disclosed for offsetting the normal gravitational forces exerted on a rotatable cylindrical hood for an incubator. The mechanism includes a specially shaped cam that is fixed with respect to the rotatable hood. A cam follower, mounted on a slide movable with the rotatable hood, is spring biased against the cam. As the rotatable hood is moved to various positions, the spring loading and cam profile coact to produce a counter-rotational force that is opposite and equal to the force of gravity acting upon the hood at any point in its rotation. One or more detents is provided in the cam at predetermined positions such that the cam follower can be positioned within one of the detents at one or more desired positions of hood rotation such that the hood may be held at that selected position.

4 Claims, 5 Drawing Figures

COUNTERBALANCE MECHANISM FOR INCUBATOR HOOD

BACKGROUND OF THE INVENTION

This invention relates to a counterbalancing mechanism specially adapted for an incubator having a hood rotatable for enclosing or providing access to an infant.

The mechanism was particularly devised to counteract the force of gravity acting upon such rotatable hoods and which force tends to close such hoods, or open the same depending upon the hood position. The problem is particularly difficult inasmuch as operation of the hood to open or close the same is desired to be easily movable by attending personnel such as a nurse, yet the hood obviously must have some resistance or force that acts against the normal gravitational force to prevent the hood from slamming shut. Since the gravitational force changes in accordance with the hood position, the counterbalancing mechanism should have some means to provide only a counterbalance force in any hood position about equal to the force of gravity.

SUMMARY OF THE INVENTION

Now, in accordance with the present invention, there is provided a counterbalancing mechanism that counteracts the force of gravity acting upon the rotatable hood and which is designed to provide a counterbalance force equal to the gravitational force upon the hood at any hood position.

The mechanism includes a cam that is fixed to the incubator itself and remains fixed during rotational movement of the hood. The hood and counterbalancing mechanism rotate about the cam axis and a cam follower moves around the outer cam profile. The cam follower is held within a slide and which provides a spring bias holding the cam follower against the cam surface.

By designing the cam profile, and providing a known spring bias, a torque can be produced that is equal to and opposite the force generated by gravity acting upon the rotating hood. As such, it can, by mathematical determination, provide the counterforce to gravity at any desired position of the hood. Further, one or more detents are provided on the cam profile that cause the cam follower to hold its position about the cam profile such that the hood is retained in one or more predetermined positions and will not move from these positions until extra force is used by attending personnel to move the hood.

The system thus provides, for any particular hood position or movement, a corresponding counterbalancing force to gravity acting upon the hood and such force may be mathematically designed by known relationships between the spring bias, cam follower contact angle and cam profile.

The foregoing and other advantages and features of the present invention will become readily apparent from the following description.

BRIEF DESCRIPTION OF THE DRAWINGS

The invention is diagramatically illustrated by way of example in the drawings appended hereto, in which.

DESCRIPTION OF THE PREFERRED EMBODIMENT

Figure 1:
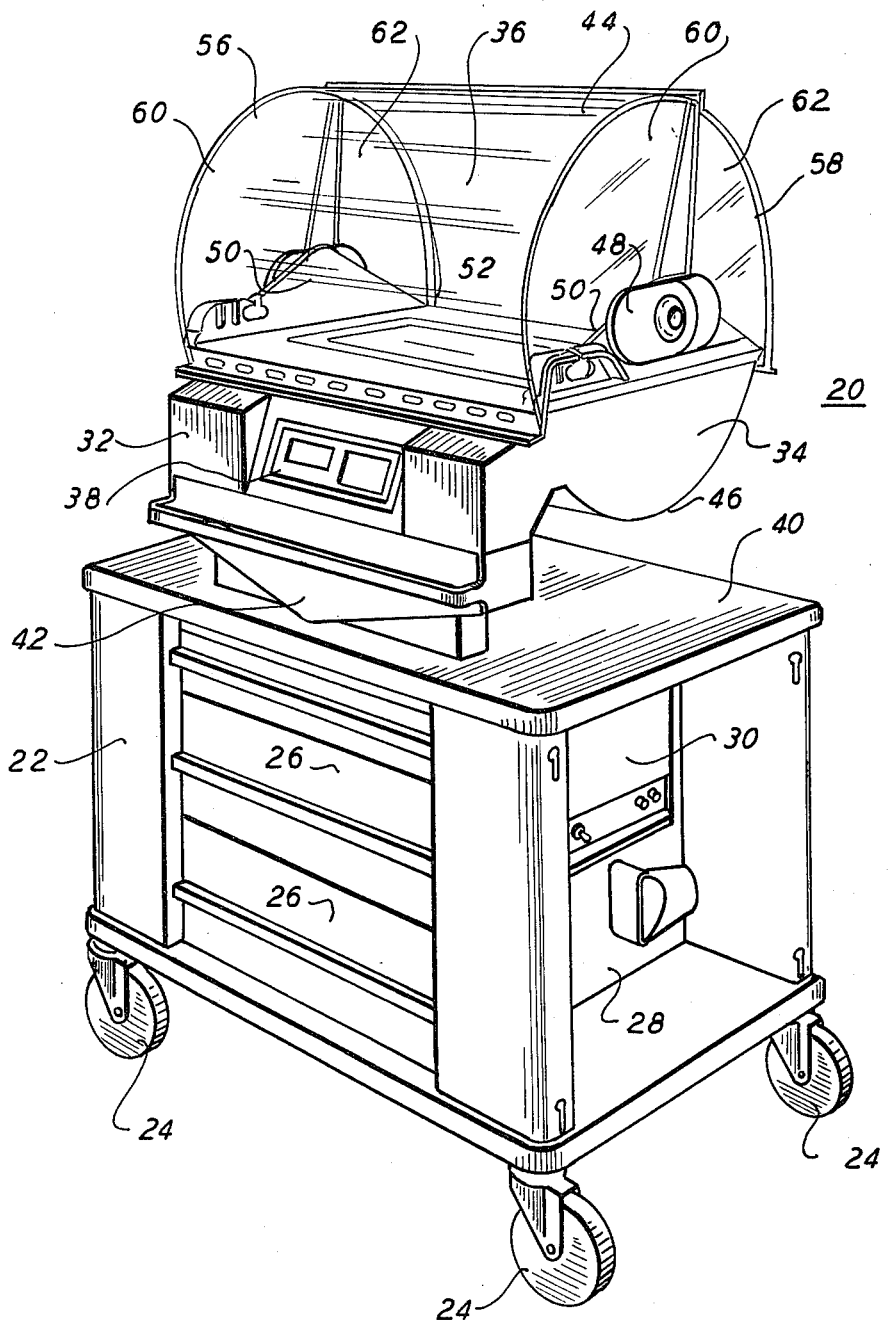
FIG. 1 is an isometric view of an infant incubator having a rotating hood to which the present invention is particularly adapted.

In FIG. 1 there is shown an incubator 20 installed atop a cabinet 22 which may be movable on wheels 24. The cabinet 22 may also include convenience items such as drawers 26 and an open recessed area 28 for storage of equipment needed for attending to an infant within incubator 20. Electronic equipment 30 for control of environment conditions for the infant may also be provided.

Extending upwardly from the cabinet 22 is the incubator base 32 having a cantelever structure 34 and which underlies the infant compartment 36. A control panel 38 centralizes controls for selecting and maintaining the desired environment within infant compartment 36. The incubator base 32 may be affixed on the top surface 40 of the cabinet 22 through a junction 42 which allows for movement of the incubator 20 to various tilted positions.

A cylindrical hood means 44 encloses infant compartment 36. The bottom 46 of the cantelever structure 34 is cylindrically shaped and conforms to the cylindrical hood means 44 when the same is opened.

The counterbalance mechanism 48 is positioned at the top of flanges 50 on both ends of the incubator 20. Within infant compartment 36 is a bottom support 52 on which the infant lies.

In the embodiment shown, the cylindrical hood means 44 comprises a plurality of sections, shown as a front hood 56 and rear hood 58 having diameters such that each can be rotated independent of the other.

Both the front hood 56 and rear hood 58 have end walls, respectively, 60 and 62 and each of the front and rear hoods, 56,58 are cylindrical being comprised of a portion of a circle.

As described hereinafter, only one counterbalance mechanism 48 will be explained in detail, it being obvious that at least one counterbalance mechanism 48 will be needed for each rotatable hood whether the cylindrical hood means 44 be comprises of one or a plurality of individually movable hoods.

Figure 3:
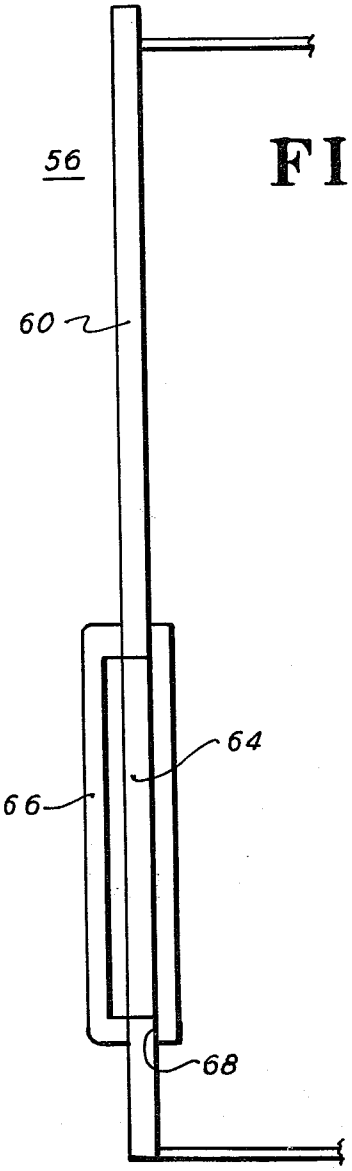
FIG. 3 is an end view of the hood section of FIG. 2.
Figure 2:
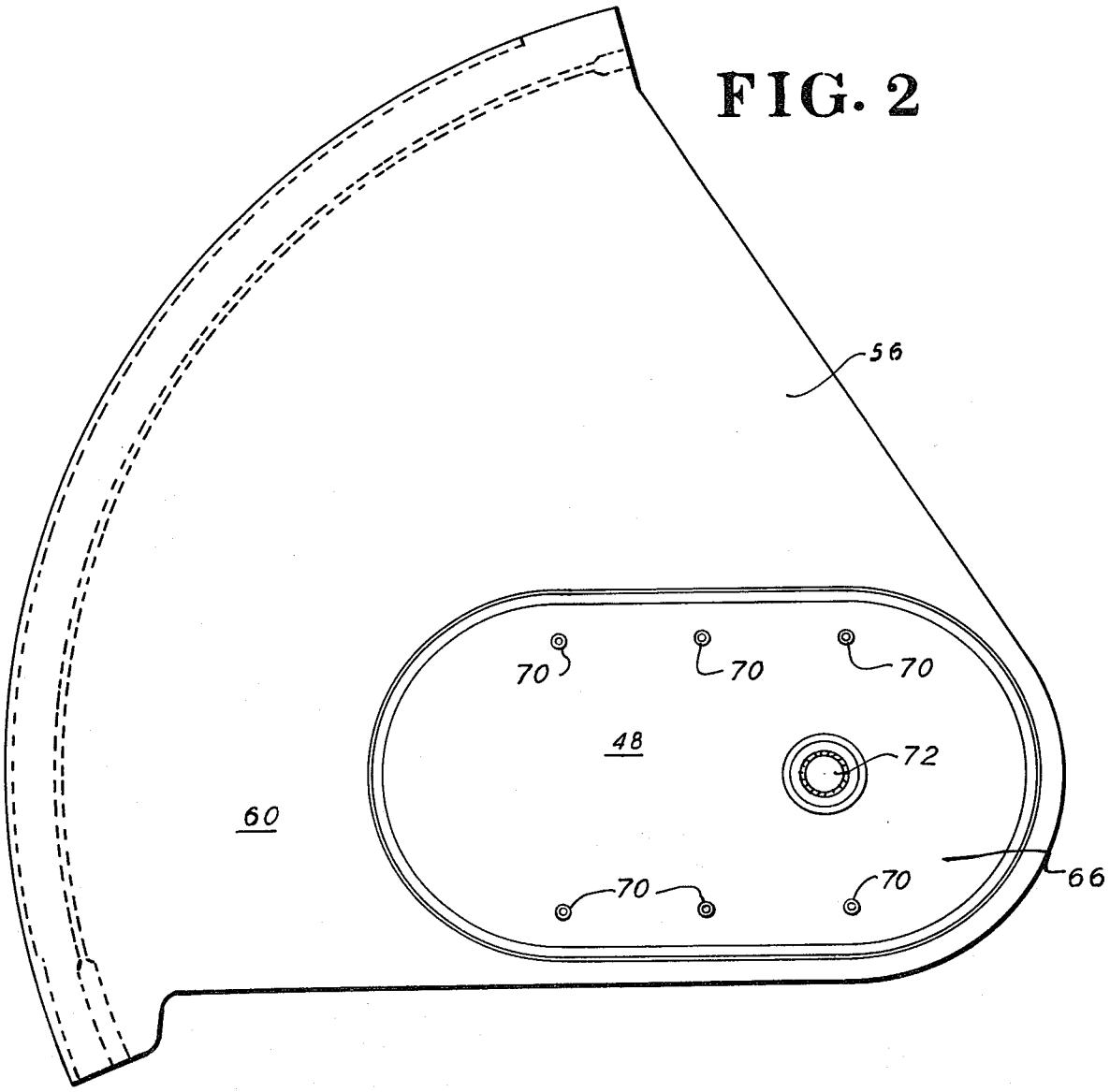
FIG. 2 is a side view, partially in section, of one of the rotatable hoods of the FIG. 1 incubator.

Turning now to FIGS. 2 and 3, there is shown, respectively, a side view and an end view of a counterbalance mechanism 48 affixed in place on front hood 56. The counterbalance mechanism 48 broadly includes an inner housing 64, preferably of plastic and an outer cover 66, also of plastic, the end wall 60 of the front hood 56 is secured to the inner housing 64 at the surface 68 in a manner to be explained.

A plurality of screws 70 affix the outer cover 66 to the inner housing 64. The counterbalance mechanism 48 has an opening 72 through the same with a keying means within opening 72 adapted to accept a shaft, not shown, in FIGS. 2 and 3, which holds the counterbalance mechansim 48 in position with one of the flanges 50 (FIG. 1).

Figure 4:
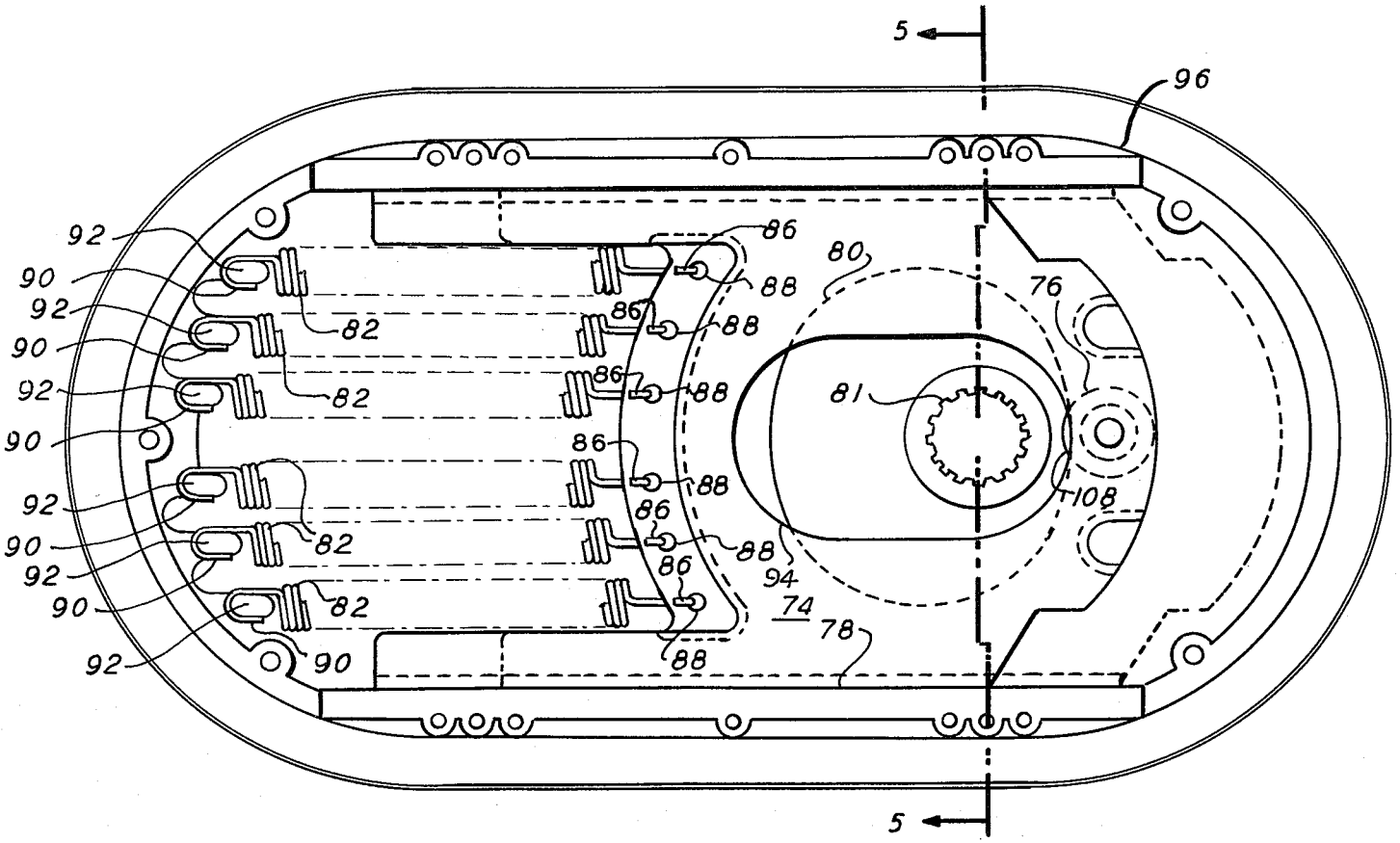
FIG. 4 is a side cross-sectional view of the counterbalancing mechanism.
Figure 5:
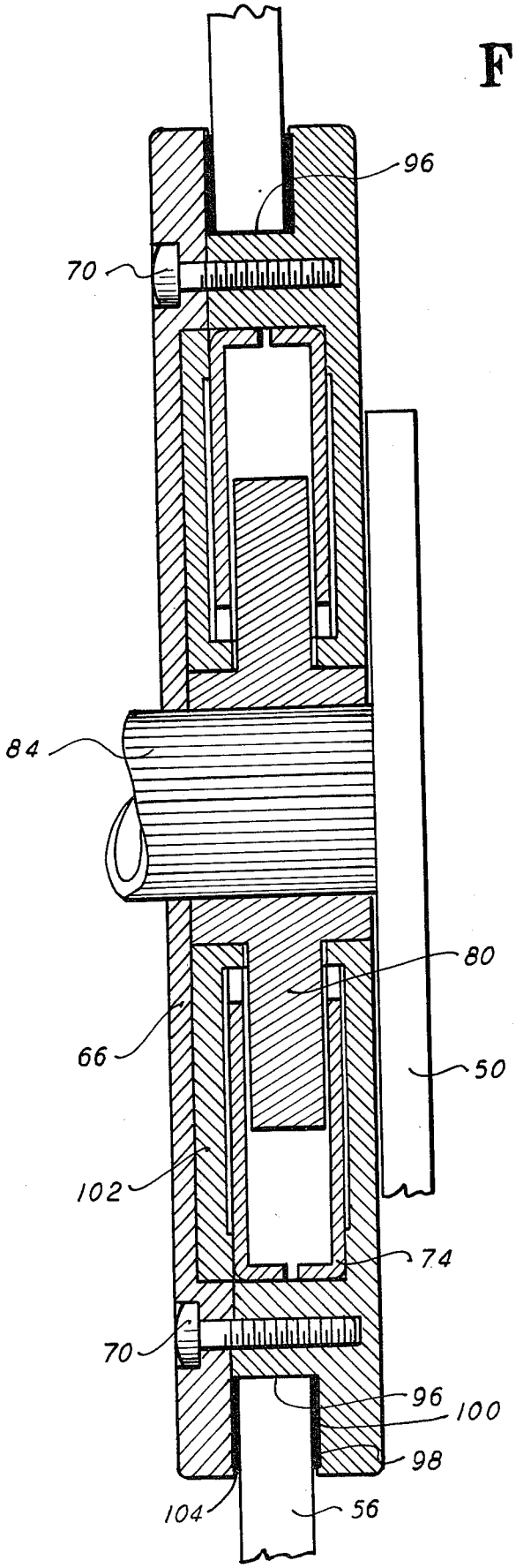
FIG. 5 is an end cross-sectional view of the counterbalancing mechanism taken along the lines 5—5 of FIG. 4.

In FIGS. 4 and 5, cross-sectional views, respectively, from the front and side, show the counterbalance mechanism 48 in detail.

In particular, FIG. 4 is a view of the counterbalance mechanism 48 having the outer cover 66 removed. Fitted within the inner housing 64 is a movable slide 74. As shown in FIG. 4, the movable slide 74 is movable within certain limits and its two extreme positions of movement are depicted in solid line and dotted line positions. A cam follower 76 is affixed to the movable slide 74 and moves therewith within guide recesses 78 formed in the inner housing 64. A cam 80, shown partly in section, is positioned within the movable slide 74 and is held in position by a splined or otherwise keyed shaft passing through opening 81 in the cam 80. The shaft 84 (FIG. 5), in turn, is fixed firmly to the incubator 20 on flanges 50 and thus cam 80 is not movable with respect to the incubator 20.

The cam follower 76 and, of course movable slide 74, is biased against cam 80 by means of a plurality of springs 82, each of which has one end 86 fixed to the slide 74 by means such as holes 88 and the other end 90 fixed with respect to the inner housing 64 by pegs 92 formed therein.

A suitable elongated opening 94 in the movable slide 74 is provided such that the movable slide 74 may move with respect to the cam 80 and shaft 84 without interference therewith.

The front hood 56 is assembled to the counterbalance mechanism 48 (see FIG. 5) by providing an elongated opening therein which fits over the inner hub 96 and seats against the outer peripheral surface 98 of the inner housing 64. A sealing gasket 100 is provided on the outer peripheral surface 98 to provide a good gripping surface against front hood 56. An inner cover 102 fits over the internal portion of the inner housing 64 and the outer cover 66 is secured to inner housing 64 by the screws 70.

At the inner peripheral surface 104 of outer cover 66, there is also provided a sealing gasket 106 to tightly grip the front hood 56.

As may be now seen, the front hood 56 is thus clamped between the inner housing 64 and the outer cover 66 and is held tightly therebetween by the screws 70 threadedly engaged to the inner housing 64.

By constructing the elongated opening formed in the front hood 56 to be slightly larger than the inner hub 96 of the inner housing 64, the front hood 56 may be adjusted somewhat during assembly for proper alignment before tightening the screws 70.

As now may be seen, the counterbalance mechansim 48 thus comprises a movable section that is affixed to and rotates with the front hood 56 as it is rotated, that rotatable portion including the inner housing 64, outer cover 66, movable slide 74, cam follower 76, etc. and which all rotate around the fixed cam 80 as the front hood 56 is rotated.

As may also be seen, the profile of the cam 80, along with the amount of tension or bias exerted by springs 82 holding the cam follower 76 against cam 80 determines the counter-rotational force that may be mathematically determined and calculated to equal the force of gravity acting on the rotating hood at any point on its rotation.

In addition to designing the profile of cam 80 to create the precise amount of counter-rotational force, one or more detents 108 may be formed in the cam profile and adapted to receive the cam follower 76 and hold the cam follower 76 such that greated force is required to further rotate the hood in any direction. Thus, the detent 108 can provide a desired hood position where the hood may be firmly held in such position, for example, partially open so that personnel can freely attend to the infant. Thereafter, a greater than normal force is required to move the hood from that selected position. Obviously, the number of detents 108 depends upon the number of such selected positions desired for the incubator.

While the present invention has been set forth on terms of a specific embodiment, particularly with the disclosed incubator, it will be understood that the counterbalance mechanism herein disclosed may be modified or altered by those skilled in the art to various rotating hood configurations. Accordingly, the invention is to be broadly construed and limited only by the scope and spirit of the claims appended hereto.

We claim:

1. A counterbalance mechanism adapted to counteract the force of gravity acting upon a cylindrical hood, rotatable between open and closed positions of an infant incubator, said mechanism comprising a cam having a predetermined cam profile, said cam being fixed with respect to said rotatable hood, a cam follower carried by said rotatable hood and rotatable therewith, spring bias means of predetermined tension acting to force said cam follower against said cam profile, said cam follower thereby adapted to move along the said profile as the hood is rotated, said cam profile and spring bias adapted to be formed such as to counteract the gravitational forces acting upon the hood by providing about an equal force in the opposite direction of the gravitational force.

2. A counterbalance mechanism as defined in claim 1 wherein said cam profile includes at least one detent adapted to receive said cam follower to hold the hood in a selected position.

3. A counterbalance mechanism as defined in claim 1 wherein said mechanism is provided in both lateral sides of an incubator hood.

4. A counterbalance mechanism as defined in claim 1 wherein said spring bias comprises a plurality of individual springs.

* * * * *